US005616553A

United States Patent [19]

Hartman et al.

[11] Patent Number: 5,616,553

[45] **Date of Patent: *Apr. 1, 1997**

[54] FABRIC CONDITIONING COMPOSITIONS

[75] Inventors: Frederick A. Hartman, Cincinnati, Ohio; Bruno A. J. Hubesch, Tervuren; Johan G. L. Pluyter, Strombeek-Bever, both of Belgium; Manuel G. Venegas, West Chester, Ohio

[73] Assignee: The Procter & Gamble Company, Cincinnati, Ohio

[ * ] Notice: The term of this patent shall not extend beyond the expiration date of Pat. No. 5,445,747.

[21] Appl. No.: 105,421

[22] Filed: Aug. 12, 1993

[51] Int. Cl.[6] ..... D06M 16/00; D06M 13/46

[52] U.S. Cl. ..... 510/522; 510/521; 510/527; 510/530; 435/263

[58] Field of Search ..... 252/8.6, 8.8, 174.12, 252/DIG. 12; 435/263; 510/521, 522, 530, 527

[56] References Cited

U.S. PATENT DOCUMENTS

| | | | |
|---|---|---|---|
| 3,861,870 | 1/1975 | Edwards et al. | 8/115.6 |
| 3,886,075 | 5/1975 | Bernardino | 252/8.75 |
| 3,974,076 | 8/1976 | Wiersema et al. | 252/8.8 |
| 4,137,180 | 1/1979 | Naik et al. | 252/8.8 |
| 4,233,164 | 11/1980 | Davis | 252/8.8 |
| 4,237,016 | 12/1980 | Rudkin et al. | 252/8.8 |
| 4,308,151 | 12/1981 | Cambre | 252/8.8 |
| 4,401,578 | 8/1983 | Verbruggen | 252/8.8 |
| 4,429,859 | 2/1984 | Steiner et al. | 252/8.8 |
| 4,435,307 | 3/1984 | Barbesgaard et al. | 252/174.12 |
| 4,439,335 | 3/1984 | Burns | 252/8.75 |
| 4,479,881 | 10/1984 | Tai | 252/8.8 |
| 4,648,979 | 3/1987 | Parslow et al. | 252/8.8 |
| 4,661,269 | 4/1987 | Trinh et al. | 252/8.8 |
| 4,661,289 | 4/1987 | Parslow et al. | 252/8.8 |
| 4,738,682 | 4/1988 | Boegh et al. | 8/401 |
| 4,767,547 | 8/1988 | Straathof et al. | 252/8.8 |
| 5,009,800 | 4/1991 | Foster | 252/8.9 |
| 5,093,014 | 3/1992 | Neillie | 252/8.8 |
| 5,120,463 | 6/1992 | Bjork et al. | 252/174.12 |
| 5,156,761 | 10/1992 | Aaslyng et al. | 252/174.12 |
| 5,213,581 | 5/1993 | Olson et al. | 8/401 |
| 5,232,851 | 8/1993 | Cox et al. | 252/174.12 |
| 5,246,853 | 9/1993 | Clarkson et al. | 435/263 |

FOREIGN PATENT DOCUMENTS

| | | |
|---|---|---|
| 173397 | 3/1986 | European Pat. Off. . |
| 269168 | 6/1988 | European Pat. Off. . |
| 350098 | 1/1990 | European Pat. Off. . |
| 495554 | 7/1992 | European Pat. Off. . |
| 239910 | 10/1992 | European Pat. Off. . |
| 8054-082 | 3/1983 | Japan . |
| 8036-217 | 3/1983 | Japan . |
| 63/6098 | 1/1988 | Japan . |
| 1040-681 | 2/1989 | Japan . |
| 1368599 | 10/1974 | United Kingdom . |
| 2075028 | 11/1981 | United Kingdom . |
| 2094826 | 9/1982 | United Kingdom . |
| 2095275 | 9/1982 | United Kingdom . |
| 2258655 | 2/1993 | United Kingdom . |
| 91/13136 | 9/1991 | WIPO . |
| 91/17243 | 11/1991 | WIPO . |
| 93/12224 | 6/1993 | WIPO . |

OTHER PUBLICATIONS

Chemical Abstract Service vol. 107:156217q (1987) [No Month].

*Primary Examiner*—Anthony Green
*Attorney, Agent, or Firm*—Kim William Zerby; Jerry J. Yetter; Jacobus C. Rasser

[57] ABSTRACT

The present invention relates to aqueous fabric conditioning compositions containing a quaternary ammonium compound and/or amine precursor thereof of the formulae (I) or (II) herein, and a cellulase, said compositions having a neat pH at 20° C., of from about 2.0 to about 4.5.

24 Claims, No Drawings

FABRIC CONDITIONING COMPOSITIONS

Technical Field

The present invention relates to fabric-conditioning compositions to be used in the rinse cycle of laundry washing processes, in order to impart softness as well as fabric appearance benefits to fabrics.

The present compositions contain a selected fabric softening active and a cellulase, and are formulated at a narrowly defined acidic pH range which ensures optimal storage stability of both the softening active and the cellulase.

BACKGROUND OF THE INVENTION

Fabric conditioning compositions, in particular fabric softening compositions to be used in the rinse cycle of laundry washing processes, are well known.

Typically, such compositions contain a water-insoluble quaternary-ammonium fabric softening agent, the most commonly used having been di-long alkyl chain ammonium chloride.

In recent years, the need has arisen for more environmentally-friendly materials, and rapidly biodegradable quaternary ammonium compounds have been presented as alternatives to the traditionaly used di-long chain ammonium chlorides. Such quaternary ammonium compounds contain long chain alk(en)yl groups interrupted by functional groups such as carboxy groups.

Said materials and fabric softening compositions containing them are disclosed in numerous publications such as EPA 040 562, and EPA 239 910, incorporated herein by reference in their entirety.

In EPA 239 910, it has been disclosed that a pH range of from 2.5 to 4.2 provides optimum storage stability to said rapidly biodegradable ammonium compounds.

On the other hand, the anti-harshening effect of cellulase on fabrics is known from e.g. FR 2 481 712 or GB-A-1 368 599, as well as their fabric care benefits, disclosed in e.g. EPA 269 168, all incorporated herein by reference in their entirety. Cellulases have been mainly described however for use in detergent compositions to be used in the main wash cycle of laundry processes, and have found some commercial application in this context. The use of cellulases in rinse added fabric softener compositions has not been pursued so far; one of the potential issues to be resolved being to provide acceptable stability of the cellulase in such compositions upon storage.

While the pH of the rinse-added fabric softening compositions in GB-A-1 368 599, as well as all compositions containing traditional fabric softener actives was typically in the range of 5 to 7, and the "pH optimum" for cellulase activity is known to be from 5 to 9.5, it has now been surprisingly discovered that when cellulases are included in fabric softening compositions of the type disclosed in EPA 239 910, i.e. with certain rapidly biodegradable ammonium compounds or their amine precursors and at a narrowly defined low pH range, the stability of said cellulases upon storage is remarkable.

The present invention therefore allows to formulate fabric conditioning compositions which are preferably storage stable, and therefore Where the full potential of both the softening actives and the cellulases, in terms of softness and fabric care benefits, is preserved.

SUMMARY OF THE INVENTION

The present invention relates to fabric conditioning compositions containing an ammonium compound and/or amine precursor thereof of the formulae (I) or (II) herein, and a cellulase, said compositions having a neat pH at 20° C., of from about 2.0 to about 4.5, preferably about 2.0 to about 3.5.

DETAILED DESCRIPTION OF THE INVENTION

The quaternary ammonium compounds and amine precursors:

The quaternary ammonium compounds and amine precursors herein have the formula (I) or (II), below:

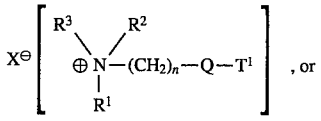

(I)

, or

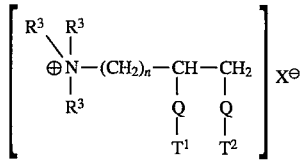

(II)

Q is

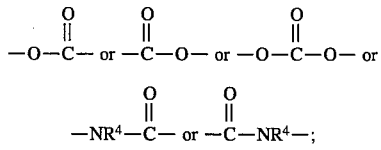

$R^1$ is $(CH_2)_n$—Q—$T^2$ or $T^3$;

$R^2$ is $(CH_2)_m$—Q—$T^4$ or $T^5$ or $R^3$;

$R^3$ is $C_1$–$C_4$ alkyl or $C_1$–$C_4$ hydroxyalkyl or H;

$R^4$ is H or $C_1$–$C_4$ alkyl or $C_1$–$C_4$ hydroxyalkyl;

$T^1$, $T^2$, $T^3$, $T^4$, $T^5$ are (the same or different) $C_{11}$–$C_{22}$ alkyl or alkenyl;

n and m are integers from 1 to 4; and $X^-$ is a softener-compatible anion.

The alkyl, or alkenyl, chain $T^1$, $T^2$, $T^3$, $T^4$, $T^5$ must contain at least 11 carbon atoms, preferably at least 16 carbon atoms. The chain may be straight or branched.

Tallow is a convenient and inexpensive source of long chain alkyl and alkenyl material. The compounds wherein $T^1$, $T^2$, $T^3$, $T^4$, $T^5$ represents the mixture of long chain materials typical for tallow are particularly preferred.

Specific examples of quaternary ammonium compounds suitable for use in the aqueous fabric softening compositions herein include:

1) N,N-di(tallowoyl-oxy-ethyl)-N,N-dimethyl ammonium chloride;

2) N,N-di(tallowoyl-oxy-ethyl)-N-methyl, N-(2-hydroxyethyl);

3) N,N-di(2-tallowyloxy-2-oxo-ethyl)-N,N-dimethyl ammonium chloride;

4) N,N-di(2-tallowyloxyethylcarbonyloxyethyl)-N,N-dimethyl ammonium chloride;

5) N-(2-tallowoyloxy-2-ethyl)-N-(2-tallowyloxy-2-oxo-ethyl)-N,N-dimethyl ammonium chloride;

6) N,N,N-tri(tallowyl-oxy-ethyl)-N-methyl ammonium chloride;

7) N-(2-tallowyloxy-2-oxoethyl)-N-(tallowyl-N,N-dimethyl-ammonium chloride; and 8) 1,2-ditallowyl oxy-3-trimethylammoniopropane chloride; and mixtures of any of the above materials.

Of these, compounds 1–7 are examples of compounds of Formula (I); compound 8 is a compound of Formula (II).

Particularly preferred is N, N-di( tallowoyl-oxy-ethyl)-N, N-dimethyl ammonium chloride, where the tallow chains are at least partially unsaturated.

The level of unsaturation of the tallow chain can be measured by the Iodine Value (IV) of the corresponding fatty acid, which in the present case should preferably be in the range of from 5 to 100 with two categories of compounds being distinguished, having a IV below or above 25.

Indeed, for compounds of Formula (I) made from tallow fatty acids having a IV of from 5 to 25, preferably 15 to 20, it has been found that a cis/trans isomer weight ratio greater than about 30/70, preferably greater than about 50/50 and more preferably greater than about 70/30 provides optimal concentrability.

For compounds of Formula (I) made from tallow fatty acids having a IV of above 25, the ratio of cis to trans isomers has been found to be less critical unless very high concentrations are needed.

Other examples of suitable quaternary ammoniums of Formula (I) and (II) are obtained by, e.g., replacing "tallow" in the above compounds with, for example, coco, palm, lauryl, oleyl, ricinoleyl, stearyl, palmityl, or the like, said fatty acyl chains being either fully saturated, or preferably at least partly unsaturated;

replacing "methyl" in the above compounds with ethyl, ethoxy, propyl, propoxy, isopropyl, butyl, isobutyl or t-butyl;

replacing "chloride" in the above compounds with bromide, methylsulfate, formate, sulfate, nitrate, and the like.

In fact, the anion is merely present as a counterion of the positively charged quaternary ammonium compounds. The nature of the counterion is not critical at all to the practice of the present invention. The scope of this invention is not considered limited to any particular anion.

By "amine precursors thereof" is meant the secondary or tertiary amines corresponding to the above quaternary ammonium compounds, said amines being substantially protonated in the present compositions due to the claimed pH values.

The quaternary ammonium or amine precursors compounds herein are present at levels of from about 1% to about 80% of compositions herein, depending on the composition execution which can be dilute with a preferred level of active from about 5% to about 15%, or concentrated, with a preferred level of active from about 15% to about 50%, most preferably about 15% to about 35%.

The cellulase

The cellulase usable in the compositions herein can be any bacterial or fungal cellulase.

Suitable cellulases are disclosed in GB-A-2 075 028, GB-A-2 095 275 and DE-OS-24 47 832, all incorporated herein by reference in their entirety.

Examples Of such cellulases are cellulase produced by a strain of Humicola insolens (Humicola grisea var. thermoidea), particularly by the Humicola strain DSM 1800, and cellulase 212-producing fungus belonging to the genus Aeromonas, and cellulase extracted from the hepatopancreas of a marine mullosc (Dolabella Auricula Solander).

The cellulase added to the composition of the invention may be in the form of a non-dusting granulate, e.g. "marumes" or "prills", or in the form of a liquid, e.g., one in which the cellulase is provided as a cellulase concentrate suspended in e.g. a nonionic surfactant or dissolved in an aqueous medium.

Preferred cellulases for use herein are characterized in that they provide at least 10% removal of immobilized radioactive labelled carboxymethylcellulose according to the $C^{14}$CMC-method described in EPA 350 098 (incorporated herein by reference in its entirety) at $25\times10^{-6}$% by weight of cellulase protein in the laundry test solution.

Most preferred cellulases are those as described in International Patent Application WO91/17243 (incorporated herein by reference in its entirety). For example, a cellulase preparation useful in the compositions of the invention can consist essentially of a homogeneous endoglucanase component, which is immunoreactive with an antibody raised against a highly purified 43 kD cellulase derived from *Humicola insolens*, DSM 1800, or which is homologous to said 43 kD endoglucanase.

The cellulases herein should be used at a level equivalent to an activity from about 0.5 to about 1000 CEVU/gram of composition [CEVU=Cellulase (equivalent) Viscosity Unit, as described, for example, in WO 91/13136, incorporated herein by reference in its entirety], preferably about 1 to about 250, most preferably about 2.5 to about 100.

For typical machine washing processes the levels of cellulase are preferably selected to provide cellulase activity at a level such that the compositions deliver an effective amount of cellulase below about 50 CEVU's per liter of rinse solution, preferably below about 30 CEVU's per liter, more preferably below about 25 CEVU's per liter, and most preferably below about 20 CEVU's per liter, during the rinse cycle of a machine washing process. Preferably, the present invention compositions are used in the rinse cycle at a level to provide from about 5 CEVU's per liter rinse solution to about 50 CEVU's per liter rinse solution, more preferably from about 5 CEVU's per liter to about 30 CEVU's per liter, even more preferably from about 10 CEVU's per liter to about 25 CEVU's per liter, and most preferably from about 10 CEVU's per liter to about 20 CEVU's per liter.

The pH

The pH of the compositions herein is an essential parameter of the present invention. Indeed, it influences the stability of the quaternary ammonium or amine precursors compounds, and of the cellulase, especially in prolonged storage conditions.

The pH, as defined in the present context, is measured in the neat compositions, in the continuous phase after separation of the dispersed phase by ultra centrifugation, at 20° C. For optimum hydrolytic stability of the compositions, the neat pH, measured in the above-mentioned conditions, must be in the range of from about 2.0 to about 4.5, preferably about 2.0 to about 3.5.

The pH of the compositions herein can be regulated by the addition of a Bronsted acid.

Examples of suitable acids include the inorganic mineral acids, carboxylic acids, in particular the low molecular weight ($C_1$–$C_5$) carboxylic acids, and alkylsulfonic acids. Suitable inorganic acids include HCl, $H_2SO_4$, $HNO_3$ and $H_3PO_4$. Suitable organic acids include formic, acetic, citric, methylsulfonic and ethylsulfonic acid. Preferred acids are citric, hydrochloric, phosphoric, formic, methylsulfonic acid, and benzoic acids.

Optional Ingredients

Fully formulated fabric softening compositions preferably contain, in addition to the compounds of Formula I or II herein, one or more of the following ingredients:

Firstly, the presence of polymer having a partial or net cationic charge, can be useful to further increase the cellulase stability in the compositions herein. Such polymers can be used at levels of from 0.001% to 10%, preferably 0.01% to 2% by weight of the compositions.

Such polymers having a partial cationic charge can be polyamine N-oxide containing polymers which contain units having the following structure formula (A):

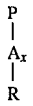

(A)

wherein P is a polymer,sable unit, whereto the R—N—→O group can be attached to or wherein the R—N→O group forms part of the polymerisable unit or a combination of both.

A is

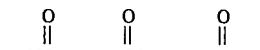

—O—, —S—, —N—; x is 0 or 1; R are aliphatic, ethoxylated aliphatics, aromatic, heterocyclic or alicyclic groups or any combination thereof whereto the nitrogen of the N→O group can be attached or wherein the nitrogen of the N→O group is part of these groups.

The N→O group can be represented by the following general structures:

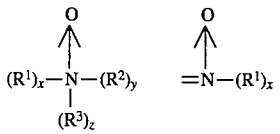

wherein $R^1$, $R^2$, and $R^3$ are aliphatic groups, aromatic, heterocyclic or alicyclic groups or combinations thereof, x or/and y or/and z is 0 or 1 and wherein the nitrogen of the N→O group can be attached or wherein the nitrogen of the N→O group forms part of these groups.

The N→O group can be part of the polymer,sable unit (P) or can be attached to the polymeric backbone or a combination of both.

Suitable polyamine N-oxides wherein the N→O group forms part of the polymerisable unit comprise polyamine N-oxides wherein R is selected from aliphatic, aromatic, alicyclic or heterocyclic groups.

One class of said polyamine N-oxides comprises the group of polyamine N-oxides wherein the nitrogen of the N→O group forms part of the R-group. Preferred polyamine N-oxides are those wherein R is a heterocyclic group such as pyrridine, pyrrole, imidazole, pyrrolidine, piperidine, quinoline, acridine and derivatives thereof.

Another class of said polyamine N-oxides comprises the group of polyamine N-oxides wherein the nitrogen of the N→O group is attached to the R-group.

Other suitable polyamine N-oxides are the polyamine oxides whereto the N→O group is attached to the polymer, sable unit.

Preferred class of these polyamine N-oxides are the polyamine N-oxides having the general formula (A) wherein R is an aromatic, heterocyclic or alicyclic groups wherein the nitrogen of the N→O functional group is part of said R group.

Examples of these classes are polyamine oxides wherein R is a heterocyclic compound such as pyrridine, pyrrole, imidazole and derivatives thereof.

Another preferred class of polyamine N-oxides are the polyamine oxides having the general formula (A) wherein R are aromatic, heterocyclic or alicyclic groups wherein the nitrogen of the N→O functional group is attached to said R groups.

Examples of these classes are polyamine oxides wherein R groups can be aromatic such as phenyl.

Any polymer backbone can be used as long as the amine oxide polymer formed is water-soluble and has dye transfer inhibiting properties. Examples of suitable polymeric backbones are polyvinyls, polyalkylenes, polyesters, polyethers, polyamide, polyimides, polyacrylates and mixtures thereof.

The amine N-oxide polymers useful herein typically have a ratio of amine to the amine N-oxide of about 10:1 to about 1:1000000. However the amount of amine oxide groups present in the polyamine N-oxide containing polymer can be varied by appropriate copolymerization or by appropriate degree of N-oxidation. Preferably, the ratio of amine to amine N-oxide is from about 2:3 to about 1: 1000000. More preferably from about 1:4 to about 1:1000000, most preferably from about 1:7 to about 1:1000000. The polymers of the present invention actually encompass random or block copolymers where one monomer type is an amine N-oxide and the other monomer type is either an amine N-oxide or not. The amine oxide unit of the polyamine N-oxides has a PKa<10, preferably PKa<7, more preferred PKa<6.

The polyamine N-oxide containing polymer can be obtained in almost any degree of polymerisation. The degree of polymerisation is not critical provided the material has the desired water-solubility and dye-suspending power.

Typically, the average molecular weight of the polyamine N-oxide containing polymer is within the range of about 500 to about 1000,000; preferably from about 1,000 to about 50,000, more preferably from about 2,000 to about 30,000, most preferably from about 3,000 to about 20,000.

Such polymers having a net cationic charge include polyvinylpyrrolidone (PVP) as well as copolymers of N-vinylimidazole N-vinyl pyrrolidone, having an average molecular weight range in the range about 5,000 to about 100,000,preferably about 5,000 to about 50,000; said copolymers having a molar ratio of N-vinylimidazole to N-vinylpyrrolidone from about 1 to about 0.2, preferably from about 0.8 to about 0.3.

Other optional ingredients include:

Additional softening agents:

which are nonionic fabric softener materials. Typically, such nonionic fabric softener materials have a HLB of from about 2 to about 9, more typically from about 3 to about 7. Such nonionic fabric softener materials tend to be readily dispersed either by themselves, or when combined with other materials such as single-long-chain alkyl cationic surfactant described in detail hereinafter. Dispersibility can be improved by using more single-long-chain alkyl cationic surfactant, mixture with other materials as set forth hereinafter, use of hotter water, and/or more agitation. In general, the materials selected should be relatively crystalline, higher melting, (e.g. >40° C.) and relatively water-insoluble.

The level of optional nonionic softener in the compositions herein is typically from about 0.1% to about 10%, preferably from about 1% to about 5%.

Preferred nonionic softeners are fatty acid partial esters of polyhydric alcohols, or anhydrides thereof, wherein the alcohol, or anhydride, contains from 2 to 18, preferably from 2 to 8, carbon atoms, and each fatty acid moiety contains from 12 to 30, preferably from 16 to 20, carbon atoms.

Typically, such softeners contain from one to 3, preferably 2 fatty acid groups per molecule.

The polyhydric alcohol portion of the ester can be ethylene glycol, glycerol, poly (e.g., di-, tri-, tetra, penta-, and/or hexa-) glycerol, xylitol, sucrose, erythritol, pentaerythritol, sorbitol or sorbitan. Sorbitan esters and polyglycerol monostearate are particularly preferred.

The fatty acid portion of the ester is normally derived from fatty acids having from 12 to 30, preferably from 16 to 20, carbon atoms, typical examples of said fatty acids being lauric acid, myristic acid, palmitic acid, stearic acid and behenic acid.

Highly preferred optional nonionic softening agents for use in the present invention are the sorbitan esters, which are esterified dehydration products of sorbitol, and the glycerol esters.

Commercial sorbitan monostearate is a suitable material. Mixtures of sorbitan stearate and sorbitan palmirate having stearate/palmitate weigt ratios varying between about 10:1 and about 1:10, and 1,5-sorbitan esters are also useful.

Glycerol and polyglycerol esters, especially glycerol, diglycerol, triglycerol, and polyglycerol mono- and/or diesters, preferably mono-, are preferred herein (e.g. polyglycerol monostearate with a trade name of Radiasurf 7248).

Useful glycerol and polyglycerol esters include monoesters with stearic, oleic, palmitic, lauric, isostearic, myristic, and/or behenic acids and the diesters of stearic, oleic, palmitic, lauric, isostearic, behenic, and/or myristic acids. It is understood that the typical mono-ester contains some di- and triester, etc.

The "glycerol esters" also include the polyglycerol, e.g., diglycerol through octaglycerol esters. The polyglycerol polyols are formed by condensing glycerin or epichlorohydrin together to link the glycerol moieties via ether linkages. The mono- and/or diesters of the polyglycerol polyols are preferred, the fatty acyl groups typically being those described hereinbefore for the sorbitan and glycerol esters.

Surfactant/Concentration Aids

Although as stated before, relatively concentrated compositions of the unsaturated material of Formula (I) and (II) above can be prepared that are stable without the addition of concentration aids, the concentrated compositions of the present invention may require organic and/or inorganic concentration aids to go to even higher concentrations and/or to meet higher stability standards depending on the other ingredients.

Surfactant concentration aids are typically selected from the group consisting of single long chain alkyl cationic surfactants; nonionic surfactants; amine oxides; fatty acids; or mixtures thereof, typically used at a level of from 0 to about 15% of the composition.

Such mono-long-chain-alkyl cationic surfactants useful in the present invention are, preferably, quaternary ammonium salts of the general formula:

$$[R^2N^+R^3]X^-$$

wherein the $R^2$ group is $C_{10}$–$C_{22}$ hydrocarbon group, preferably $C_{12}$–$C_{18}$ alkyl group of the corresponding ester linkage interrupted group with a short alkylene ($C_1$–$C_4$) group between the ester linkage and the N, and having a similar hydrocarbon group, e.g., a fatty acid ester of choline, preferably $C_{12}$–$C_{14}$ (coco) choline ester and/or $C_{16}$–$C_{18}$ tallow choline ester at from about 0.1% to about 20% by weight of the softener active. Each R is a $C_1$–$C_4$ alkyl or substituted (e.g., hydroxy) alkyl, or hydrogen, preferably methyl, and the counterion $X^-$ is a softener compatible anion, for example, chloride, bromide, methyl sulfate, etc.

Other cationic materials with ring structures such as alkyl imidazoline, imidazolinium, pyridine, and pyridinium salts having a single $C_{12}$–$C_{30}$ alkyl chain can also be used. Very low pH is required to stabilize, e.g., imidazoline ring structures.

Some alkyl imidazolinium salts and their imidazoline precursors useful in the present invention have the general formula:

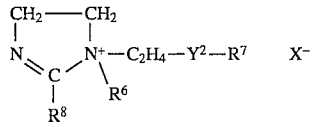

wherein $Y^2$ is —C(O)—O—, —O—(O)C—, —C(O)—N($R^5$)—, or —N($R^5$)—C(O)— in which $R^5$ is hydrogen or a $C_1$–$C_4$ alkyl radical; $R^6$ is a $C_1$–$C_4$ alkyl radical or H (for imidazoline precursors); $R^7$ and $R^8$ are each independently selected from R and $R^2$ as defined hereinbefore for the single-long-chain cationic surfactant with only one being $R^2$.

Some alkyl pyridinium salts useful in the present invention have the general formula:

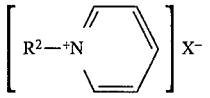

wherein $R^2$ and $X^-$ are as defined above. A typical material of this type is cetyl pyridinium chloride.

Nonionic Surfactant (Alkoxylated Materials)

Suitable nonionic surfactants for use herein include addition products of ethylene oxide and, optionally, propylene oxide, with fatty alcohols, fatty acids, fatty amines, etc.

Suitable compounds are substantially water-soluble surfactants of the general formula:

$$R^2—Y—(C_2H_4O)_z—C_2H_4OH$$

wherein $R^2$ is selected from the group consisting of primary, secondary and branched chain alkyl and/or acyl hydrocarbyl groups; primary, secondary and branched chain alkenyl hydrocarbyl groups; and primary, secondary and branched chain alkyl- and alkenyl-substituted phenolic hydrocarbyl groups; said hydrocarbyl groups having a hydrocarbyl chain length of from 8 to 20, preferably from 10 to 18 carbon atoms.

Y is typically —O—, —C(O)O—, —C(O)N(R)—, or —C(O)N(R)R—, in which $R^2$ and R, when present, have the meanings given hereinbefore, and/or R can be hydrogen, and z is at least 8, preferably at least 10-11.

The nonionic surfactants herein are characterized by an HLB (hydrophiliclipophilic balance) of from 7 to 20, preferably from 8 to 15.

Examples of particularly suitable nonionic surfactants include Straight-Chain, Primary Alcohol Alkoxylates such as tallow alcohol-EO(11), tallow alcohol-EO(18), and tallow alcohol-EO(25);

Straight-Chain, Secondary Alcohol Alkoxylates such as 2-$C_{16}$EO(11); 2-$C_{20}$EO(11); and 2-$C_{16}$EO(14);

Alkyl Phenol Alkoxylates, such as p-tridecylphenol EO(11) and p-pentadecylphenol EO(18), as well as Olefinic Alkoxylates, and Branched Chain Alkoxylates such as branched chain primary and secondary alcohols which are available from the well-known "OXO" process.

Amine Oxides

Suitable amine oxides include those with one alkyl or hydroxyalkyl moiety of 8 to 28 carbon atoms, preferably from 8 to 16 carbon atoms, and two alkyl moleties selected from the group consisting of alkyl groups and hydroxyalkyl groups with 1 to 3 carbon atoms.

Examples include dimethyloctylamine oxide, diethyldecylamine oxide, bis-(2-hydroxyethyl)dodecylamine oxide, dimethyldodecyl-amine oxide, dipropyltetradecylamine oxide, methylethylhexadecylamine oxide, dimethyl-2-hydroxyoctadecylamine oxide, and coconut fatty alkyl dimethylamine oxide.

Fatty Acids

Suitable fatty acids include those containing from 12 to 25, preferably from 16 to 20 total carbon atoms, with the fatty moiety containing from 10 to 22, preferably from 10 to 14 (mid cut), carbon atoms. The shorter moiety contains from 1 to 4, preferably from 1 to 2 carbon atoms.

Electrolyte Concentration Aids

Inorganic viscosity control agents which can also act like or augment the effect of the surfactant concentration aids, include water-soluble, ionizable salts which can also optionally be incorporated into the compositions of the present invention. A wide variety of ionizable salts can be used. Examples of suitable salts are the halides of the Group IA and IIA metals of the Periodic Table of the Elements, e.g., calcium chloride, magnesium chloride, sodium chloride, potassium bromide, and lithium chloride. The ionizable salts are particularly useful during the process of mixing the ingredients to make the compositions herein, and later to obtiain the desired viscosity. The amount of ionizable salts used depends on the amount of active ingredients used in the compositions and can be adjusted according to the desires of the formulator. Typical levels of salts used to control the composition viscosity are from about 20 to about 20,000 parts per million (ppm), preferably from about 20 to about 11,000 ppm, by weight of the composition.

Alkylene polyammonium salts can be incorporated into the composition to give viscosity control in addition to or in place of the water-soluble, ionizable salts above. In addition, these agents can act as scavengers, forming ion pairs with anionic detergent carried over from the main wash, in the rinse, and on the fabrics, and may improve softness performance. These agents may stabilize the viscosity over a broader range of temperature, especially at low temperatures, compared to the inorganic electrolytes.

Specific examples of alkylene polyammonium salts include I-lysine monohydrochloride and 1,5-diammonium 2-methyl pentane dihydrochloride.

Another optional ingredient is a liquid carrier. The liquid carrier employed in the instant compositions is preferably at least primarily water due to its low cost relative availability, safety, and environmental compatibility. The level of water in the liquid carrier is preferably at least about 50%, most preferably at least about 60%, by weight of the carrier. Mixtures of water and low molecular weight, e.g., <about 200, organic solvent, e.g., lower alcohol such as ethanol, propanol, isopropanol or butanol are useful as the carrier liquid. Low molecular weight alcohols include monohydric, dihydric (glycol, etc. ) trihydric (glycerol, etc.), and higher polyhydric (polyols) alcohols.

Still other optional ingredients are stabilizers, such as well known antioxidants and reductive agents, Soil Release Polymers, bacteriocides; colorants, perfumes, preservatives, optical brighteners, anti ionisation agents, antifoam agents, and the like.

EXAMPLES 1–3:

The following concentrated compositions are prepared:

| Ingredients | Example 1 % by weight | Example 2 % by weight | Example 3 % by weight |
|---|---|---|---|
| N,N-di(2-tallowoxyl-oxy-ethyl)-N,N-dimethyl ammonium chloride IV = 18 | 23% | 23% | 23% |
| Tallowalcohol ethoxylated 25 time | 2% | 2% | 2% |
| Polyglycerolmonostearate | 3.5% | 3.5% | 3.5% |
| Cellulase* CEVU/g of composition | 8.50 | 67 | 67 |
| Hydrochloric acid | 0.08% | 0.08% | 0.08% |
| PVNO** | — | — | 0.5% |
| Polyethylene glycol MW: 4000 | 0.6% | 0.6% | 0.6% |
| Calcium chloride | 0.3% | 0.3% | 0.3% |
| Perfume | 0.9% | 0.9% | 0.9% |
| Dye, antifoam, water, minors | Balance to 100% | Balance to 100% | Balance to 100% |
| pH (neat) = 2.3 | | | |

*Most preferred cellulases are those as described in International Patent Application WO91/17243, incorporated herein by reference in its entirety. For example, a cellulase preparation useful in the compositions of the invention can consist essentially of a homogeneous endoglucanase component, which is immunoreactive with an antibody raised against a highly purified 43kD cellulase derived from *Humicola insolens*, DSM 1800, or which is homologous to said 43kD endoglucanase.

**PVNO = poly(vinylpyridine N-oxide).

The formulaes of Examples 1, 2 and 3 are stored for 1 week to 1 month at temperatures of respectively 10° C., 20° C., 25° C., and 30° C. and the stability results are remarkably good.

The formula of Example 1 is used in the typical European machine washing process to clean fabrics, especially cotton fabrics, by addition of 35 g of this composition to the rinse cycle of this process which uses 21 liters of water for the rinse solution (14 CEVU's of cellulase per liter of rinse solution) to provide cleaned fabrics having noticeable fabric benefits. Similar benefits are seen using the compositions of Examples 2 and 3.

EXAMPLE 4

The following concentrated composition is also prepared:

| Ingredients | Example 4 (% by weight) |
|---|---|
| N,N-di(2-tallowoxyl-oxy-ethyl)-N,N-dimethyl ammonium chloride IV = 55 | 26% |
| Cellulase* CEVU/g of composition | 80 |
| Hydrochloric acid | 0.08% |
| Perfume | 1.35% |
| Calcium chloride | 0.60% |
| Dye, antifoam, water and minors | balance to 100 |
| pH (neat) = 3.2 | |

*Most preferred cellulases are those as described in International Patent Application WO91/17243. For example, a cellulase preparation useful in the compositions of the invention can consist essentially of a homogeneous endoglucanase component, which is immunoreactive with an antibody raised against a highly purified 43kD cellulase derived from *Humicola insolens*, DSM 1800, or which is homologous to said 43kD endoglucanase.

The formula of Example 4 is used in the typical U.S. machine washing process to clean fabrics by addition of 30 g of this composition to the rinse cycle of this process which uses 64 liters of water for the rinse solution (37 CEVU's of cellulase per liter of rinse solution) to provide cleaned fabrics having noticeable fabric benefits. Benefits are also observed for the composition of Example 4 containing cellulase having 40 CEVU's/g of composition activity under these conditions (19 CEVU's of cellulase per liter of rinse solution).

EXAMPLE 5

The following dilute composition is also prepared:

| Ingredients | Example 5 (% by weight) |
|---|---|
| N,N-di(2-tallowoxyl-oxy-ethyl)-N,N-dimethyl ammonium chloride IV = 18 | 5.5% |
| Tallowalcohol ethoxylated 25 times | 0.4% |
| Polyglycerolmonostearate | 0.8% |
| Cellulase* CEVU/g of composition | 3.5 |
| Hydrochloric acid | 0.04% |
| Perfume | 0.25% |
| Benzoic Acid | 0.3% |
| Dye and water | balance to 100 |
| pH (neat) = 2.3 | |

*Most preferred cellulases are those as described in International Patent Application WO91/17243. For example, a cellulase preparation useful in the compositions of the invention can consist essentially of a homogeneous endoglucanase component, which is immunoreactive with an antibody raised against a highly purified 43kD cellulase derived from *Humicola insolens*, DSM 1800, or which is homologous to said 43kD endoglucanase.

What is claimed is:

1. A fabric softening composition having improved storage stability comprising cellulase and from about 1% to about 80% of a quaternary ammonium softening agent, amine precursor softening agent, or mixtures thereof of the formula:

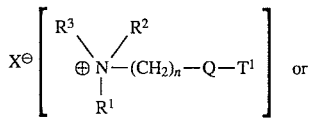

(I)

or

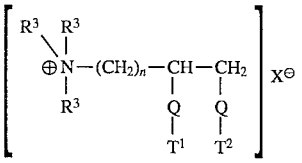

(II)

Q is

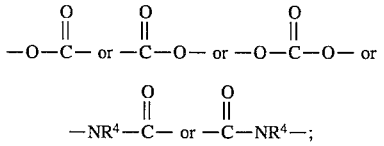

$R^1$ is $(CH_2)_n$—Q—$T^2$ or $T^3$;

$R^2$ is $(CH_2)_m$—Q—$T^4$ or $T^5$ or $R^3$;

$R^3$ is $C_1$–$C_4$ alkyl or $C_1$–$C_4$ hydroxyalkyl or H;

$R^4$ is H or $C_1$–$C_4$ alkyl or $C_1$–$C_4$ hydroxyalkyl;

$T^1$, $T^2$, $T^3$, $T^4$, $T^5$ are (the same or different) $C_{11}$–$C_{22}$ alkyl or alkenyl;

n and m are integers from 1 to 4; and $X^-$ is a softener-compatible anion, and wherein further said composition has a neat pH, at 20° C., of from about 2.0 to no more than 4.5.

2. A composition according to claim 1 wherein said pH is from about 2.0 to about 3.5.

3. A composition according to claim 1 wherein the quaternary ammonium softening agent is N,N-di(2-tallowoyl-oxy-ethyl)-N,N-dimethyl ammonium chloride.

4. A composition according to claim 2 wherein the quaternary ammonium softening agent is N,N-di(2-tallowoyl-oxy-ethyl)-N,N-dimethyl ammonium chloride.

5. A composition according to claim 3 wherein the tallow chains in said quaternary ammonium softening agent is derived from fatty acids having a Iodine Value (IV) of from 5 to 25 and a cis-trans ratio isomer weight of greater than about 30/70.

6. A composition according to claim 4 wherein the tallow chains in said quaternary ammonium softening agent is derived from fatty acids having a Iodine Value (IV) of from 5 to 25 and a cis-trans ratio isomer weight of greater than about 30/70.

7. A composition according to claim 3 wherein the tallow chains in said quaternary ammonium softening are derived from fatty acids having a Iodine Value (IV) above 25.

8. A composition according to claim 4 wherein the tallow chains in said quaternary ammonium softening are derived from fatty acids having a Iodine Value (IV) above 25.

9. A composition according to claim 1 wherein the cellulase consists essentially of a homogeneous endoglucanase component, which is immunoreactive with an antibody raised against a highly purified 43 kD cellulase derived from *Humicola insolens*, DSM 1800, or which is homologous to said 43 kD endoglucanase.

10. A composition according to claim 2 wherein the cellulase consists essentially of a homogeneous endoglucanase component, which is immunoreactive with an antibody raised against a highly purified 43kD cellulase derived from *Humicola insolens*, DSM 1800, or which is homologous to said 43 kD endoglucanase.

11. A composition according to claim 3 wherein the cellulase consists essentially of a homogeneous endoglucanase component, which is immunoreactive with an antibody raised against a highly purified 43 kD cellulase derived from *Humicola insolens*, DSM 1800, or which is homologous to said 43 kD endoglucanase.

12. A composition according to claim 4 wherein the cellulase consists essentially of a homogeneous endoglucanase component, which is immunoreactive with an antibody raised against a highly purified 43 kD cellulase derived from *Humicola insolens*, DSM 1800, or which is homologous to said 43 kD endoglucanase.

13. A composition according to claim 1 comprising from about 15% to about 50% by weight of the softening agent and a level of cellulase corresponding to an activity of about 0.5 to about 1000 CEVU/g of composition.

14. A composition according to claim 2 comprising from about 15% to about 50% by weight of the softening agent and a level of cellulase corresponding to an activity of about 0.5 to about 1000 CEVU/g of composition.

15. A composition according to claim 3 comprising from about 15% to about 50% by weight of the quaternary ammonium compound, and a level of cellulase corresponding to an activity of about 0.5 to about 1000 CEVU/g of composition.

16. A composition according to claim 4 comprising from about 15% to about 50% by weight of the quaternary ammonium compound, and a level of cellulase corresponding to an activity of about 0.5 to about 1000 CEVU/g of composition.

17. A composition according to claim 1 comprising from about 2% to about 15% by weight of the softening agent and a level of cellulase corresponding to an activity of about 0.5 to about 1000 CEVU/g of composition.

18. A composition according to claim 2 comprising from about 2% to about 15% by weight of the softening agent and a level of cellulase corresponding to an activity of about 0.5 to about 1000 CEVU/g of composition.

19. A composition according to claim 3 comprising from about 2% to about 15% by weight of the quaternary ammonium compound and a level of cellulase corresponding to an activity of about 0.5 to about 1000 CEVU/g of composition.

20. A composition according to claim 4 comprising from about 2% to about 15% by weight of the quaternary ammonium compound and a level of cellulase corresponding to an activity of about 0.5 to about 1000 CEVU/g of composition.

21. A composition according to claim 1 which additionally comprises from about 0.001% to about 10% of a polymer having a partial or net cationic charge selected from the group consisting of polyamine N-oxides, polyvinylpyrrolidone, copolymers of N-vinylimidazole N-vinyl pyrrolidone, and mixtures thereof.

22. A composition according to claim 3 which additionally comprises from about 0.001% to about 10% of a polymer having a partial or net cationic charge selected from the group consisting of polyamine N-oxides, polyvinylpyrrolidone, copolymers of N-vinylimidazole N-vinyl pyrrolidone, and mixtures thereof.

23. A composition according to claim 9 which additionally comprises from about 0.001% to about 10% of a polymer having a partial or net cationic charge selected from the group consisting of polyamine N-oxides, polyvinylpyrrolidone, copolymers of N-vinylimidazole N-vinyl pyrrolidone, and mixtures thereof.

24. A composition according to claim 10 which additionally comprises from about 0.001% to about 10% of a polymer having a partial or net cationic charge selected from the group consisting of polyamine N-oxides, polyvinylpyrrolidone, copolymers of N-vinylimidazole N-vinyl pyrrolidone, and mixtures thereof.

* * * * *